US012680535B2

(12) United States Patent
De Orte Glaria

(10) Patent No.: US 12,680,535 B2
(45) Date of Patent: Jul. 14, 2026

(54) LINEAR ACTUATOR FOR A HIGH-PRESSURE PUMP

(71) Applicant: METRONICS TECHNOLOGIES, S.L., Noain (ES)

(72) Inventor: Benito Andres De Orte Glaria, Noain (ES)

(73) Assignee: METRONICS TECHNOLOGIES, S.L., Noain (ES)

( * ) Notice: Subject to any disclaimer, the term of this patent is extended or adjusted under 35 U.S.C. 154(b) by 375 days.

(21) Appl. No.: 18/575,142

(22) PCT Filed: Jun. 30, 2022

(86) PCT No.: PCT/ES2022/070419
§ 371 (c)(1),
(2) Date: Dec. 28, 2023

(87) PCT Pub. No.: WO2023/281140
PCT Pub. Date: Jan. 12, 2023

(65) Prior Publication Data

US 2026/0117756 A1 Apr. 30, 2026

(30) Foreign Application Priority Data

Jul. 5, 2021 (ES) ..... ES202130626

(51) Int. Cl.
*F04B 9/02* (2006.01)
*F04B 17/03* (2006.01)
*F04B 19/04* (2006.01)

(52) U.S. Cl.
CPC ..... *F04B 9/02* (2013.01); *F04B 17/03* (2013.01); *F04B 19/04* (2013.01)

(58) Field of Classification Search
None
See application file for complete search history.

(56) References Cited

U.S. PATENT DOCUMENTS 522,249 A * 7/1894 Buckley ..... B65H 54/2866 187/250
996,128 A * 6/1911 Payne ..... A61M 5/31586 128/DIG. 1

(Continued)

FOREIGN PATENT DOCUMENTS

ES 2769552 T3 6/2020

OTHER PUBLICATIONS

International Search Report for corresponding International Application No. PCT/ES2022/070419 dated Sep. 1, 2022, (3 pages) and English Translation (2 pages).

*Primary Examiner* — Dominick L Plakkoottam
*Assistant Examiner* — Geoffrey S Lee
(74) *Attorney, Agent, or Firm* — LUCAS & MERCANTI, LLP

(57) ABSTRACT

A linear actuator for a high-pressure pump (1), the actuator comprising a rolling spindle with a shaft (10), a first nut (21) and a second nut (22), the nuts (21, 22) operatively connected to a first threaded section (11) and a second threaded section (12) of the shaft (10), respectively, the sections being configured with opposite threading directions, such that when rotating the nuts (21, 22) in opposite directions, the shaft (10) is axially movable with respect to the nuts (21, 22) in one same direction and an actuator for driving the movement of the shaft (10) simultaneously rotating the nuts (21, 22) in opposite directions.

12 Claims, 3 Drawing Sheets

(56) References Cited

U.S. PATENT DOCUMENTS

| | | | | | |
|---|---|---|---|---|---|
| 2,660,029 | A * | 11/1953 | Geyer | F15B 13/10 | 60/711 |
| 3,597,113 | A * | 8/1971 | Dumoulin | B01F 35/882 | 417/339 |
| 3,630,327 | A * | 12/1971 | Nelson | F16H 25/22 | 192/223 |
| 3,771,918 | A * | 11/1973 | Winter | F04B 9/02 | 92/136 |
| 4,145,165 | A * | 3/1979 | Perkins | F04B 53/144 | 417/418 |
| 4,768,911 | A * | 9/1988 | Balter | H01J 37/185 | 414/751.1 |
| 5,053,660 | A * | 10/1991 | Sneddon | F16H 25/20 | 310/20 |
| 6,068,448 | A * | 5/2000 | Muratsubaki | F04B 3/00 | 417/536 |
| 6,139,288 | A * | 10/2000 | Karasawa | F04B 17/042 | 417/415 |
| 6,362,547 | B1 * | 3/2002 | Peterson | H02K 21/14 | 310/12.32 |
| 6,531,798 | B1 * | 3/2003 | Palmero | H02K 16/00 | 310/12.32 |
| 2005/0042111 | A1 * | 2/2005 | Zaiser | F04B 25/005 | 417/225 |
| 2012/0134855 | A1 * | 5/2012 | Brown | F15B 7/08 | 417/269 |
| 2012/0207633 | A1 * | 8/2012 | Weigand | F04B 25/005 | 417/521 |
| 2015/0082925 | A1 * | 3/2015 | Ramirez, Jr. | F04B 9/047 | 74/89.23 |
| 2016/0076526 | A1 | 3/2016 | Reukers | | |

* cited by examiner

LINEAR ACTUATOR FOR A HIGH-PRESSURE PUMP

CROSS-REFERENCE TO RELATED APPLICATIONS

This application is a 371 of PCT/ES2022/070419, filed Jun. 30, 2022, which claims the benefit of Spanish Patent Application No. P202130626 filed on Jul. 5, 2021, the contents of each application are incorporated herein by reference.

TECHNICAL FIELD

The invention relates to a linear actuator driven with a rolling screw, as well as to a high-pressure pump which incorporates said linear actuator. Particularly, the invention is applicable for water jet cutting machines or high-pressure processing machines.

STATE OF THE ART

Water jet cutting machines, used for cutting by ejecting water at high pressure onto the workpiece, are well known. High-pressure processing (HPP) machines, used for processing products, such as food or beverages, by subjecting them to high pressures to, for example, sterilize the products or improve their organoleptic properties, are also well known. These machines use high-pressure pumps to raise the pressure of the working fluid to high pressures of 300-600 MPa or higher.

Linear actuators with rolling screws are increasingly used for the actuation of high-pressure pumps, as well as for a wide variety of applications, for example, in robotics. For these applications, linear actuators of this type have advantages over other types of actuators such as hydraulic or pneumatic actuators, which generate higher noise levels and excessive heating of the working fluid. Linear actuators with rolling screws provide high precision, speed, compactness and performance, and their use is usually accompanied by servomotors or stepper motors, which allow very precise control.

Linear actuators with rolling screws comprise an actuating shaft which can be axially displaced by rotating about the shaft, by means of a motor, a nut operatively connected to a threaded section of the shaft by means of balls, rollers or other rolling elements, which reduce the friction between the nut and the shaft. The nut is provided with channels in which the rolling elements, for example balls (in ball screws) or rollers (in roller screws), are arranged, with the invention likewise being applicable to all types of rolling screws, i.e., not only to ball screws or roller screws but also, for example, to trapezoidal threaded screws (ACME screws). The rotational operating movement of the motor is converted into a longitudinal motion of axial displacement of the shaft. In a pump, the axial displacement of the shaft is transmitted to a piston to compress the working fluid in a manner in itself known. For example, patent document ES-2769552-T3 discloses a linear actuator with a rolling screw for a high-pressure pump.

Inherent to the operation of linear actuators with rolling screws, the rotation of the nut about the shaft produces, in addition to the useful axial force on the shaft, a reaction torque that tends to rotate the actuating shaft about same, canceling the desired linear forward movement effect. Particularly, in the applications of linear actuators for pumps, in which the fluid compression piston displaces in contact with the walls of the compression cylinder, and particularly, in high pressure pumps, in which the piston displaces at high speeds of 0.1-0.5 m/s or higher, with a stroke of typically 100-200 mm, in order to have the desired axial actuation force, it is necessary to oppose this reaction torque with another opposing torque, which cancels it out, leaving only the axial force exerted on the actuating shaft as the resulting force.

In order to prevent unwanted rotation of the actuating shaft in linear actuators with rolling screws, guiding means for guiding the shaft longitudinally in the direction of axial displacement intended for opposing the reaction torque, whether by means of friction surfaces, linear ball or roller channels, linear ball runners, integral or guided rods or columns, etc., are known. In general, these systems oppose the rotation of the screw by resisting the corresponding torque, but inevitably provide friction when the shaft moves forward. The most common execution of these anti-rotation systems is the use of linear ball runners. These ball runners have the drawback that the flat surfaces on which they are arranged are difficult to manufacture accurately, resulting in unwanted movements that deviate the direction of axial displacement of the shaft, in addition to requiring complex casing designs to withstand the stresses of non-symmetrical runners. Other guiding means known to limit or prevent unwanted rotation of the actuating shaft incorporate cam followers or bearings coupled to the shaft withstanding the reaction torque that compensates for unwanted rotation of the shaft.

The guiding means known to limit or prevent the rotation of the shaft dissipate part of the actuator energy through their own friction, which reduces the performance of the actuator and generates losses in the form of heat that must be evacuated to the outside of the casing.

The objective of the present invention is to provide a linear actuator with a rolling screw suitable for high-pressure pumps which incorporates means for limiting or preventing the rotation of the actuating shaft about same which are complementary or alternative to those known in the state of the art, which particularly allow overcoming the drawbacks of the known linear actuators with rolling screws, as well as of the high-pressure pumps incorporating same.

OBJECT OF THE INVENTION

With the indicated objective, in addition to providing additional advantages that can be derived from this specification, the present invention provides a linear actuator comprising a rolling screw. The rolling screw comprises a shaft, a first nut and a second nut, the nuts being operatively connected to a first threaded section and a second threaded section of the shaft, respectively. The threaded sections are configured with opposite threading directions, such that when rotating the nuts in opposite directions, the shaft can be axially displaced with respect to the nuts in one and the same direction. The linear actuator according to the invention further comprises a drive for driving the displacement of the shaft, simultaneously rotating the nuts in opposite directions.

To provide the movement of axial displacement of the shaft, it is contemplated for the nuts to be fixed, particularly with respect to a casing, where they can rotate about the shaft, for example, through bearing means which lock the nuts axially inside the casing, allowing the movement of axial displacement of the shaft to result from the combination of the two different rotational movements, one in each nut.

The drive provides the simultaneous rotation of the nuts in opposite directions, i.e., one nut to the right and the other to the left, said nuts being operatively connected to the same shaft on a threaded section machined to the right and another threaded section machined to the left, respectively. The simultaneous rotation of the nuts in opposite directions results in a forward movement of the shaft in the direction of axial displacement.

The drive can be configured to provide said simultaneous rotation of the nuts in opposite directions, with the respective nuts transmitting to the shaft a torque of substantially the same magnitude or module and of opposite direction. The incorporation of means for preventing the rotation of the shaft such as those known in the state of the art can thus be dispensed with.

The drive may comprise at least one motor, such as an electric motor, preferably a servomotor or stepper motor, each motor being configured to rotate at least one of the nuts, which is itself known. Likewise, the drive may comprise a transmission gear that can be coupled to the motor of motors for rotating the nuts.

To transmit to the shaft a torque that is substantially the same and of opposite direction in the respective nuts, it is contemplated for the transmission gear to comprise a pinion, for example, a conical pinion, which meshes in a perpendicular manner with crown wheels, for example, conical crown wheels, integral with the respective nuts, with the pinion being driven by a single motor, for example, a servomotor. Preferably, the number of teeth on the driving pinion is an even number, so that the drive of both crown wheels is exactly the same, preventing asymmetries that cause vibrations or small unwanted rotations of the shaft.

To provide a torque that is substantially the same and of opposite direction, it is contemplated for the shaft, the nuts and/or the drive, particularly said transmission gear, to be configured symmetrically with respect to a plane of symmetry perpendicular to the shaft. In this sense, it is contemplated for both nuts to be configured with one and the same pitch, in correspondence with the pitch of the respective threaded sections of the shaft, and particularly for the crown wheels integral with the nuts to be of the same diameter. Likewise, the invention proposes that one of the threaded sections of the shaft extends into half of the shaft and the other threaded section extends into another half thereof, with the thread in opposite directions.

Complementarily or alternatively, the drive may comprise a controller to provide a controlled torque and/or rotating speed, driving at least one motor, for example, servomotor, or respective motors coupled to the respective nuts.

A mechanically symmetrical system which does not require additional means for preventing the rotation of the shaft for its operation is thus achieved. The reaction torque caused by the first nut on the shaft is compensated for by a torque of opposite direction caused by the second nut on the same shaft.

If the drive of both nuts is not of the same magnitude and of opposite direction, a resulting movement which, although having a controlled rotational component, may be useful to achieve movements with two degrees of freedom, i.e., both in axial displacement and in rotation about the shaft, is obtained. Likewise, the axial force and the torque exerted by the shaft can be controlled independently.

The linear actuator with a rolling screw as described is ideal for use in high-pressure pumps, such as the hydraulic intensifiers commonly used in water jet cutting, food sterilization or pasteurization by means of HPP processing, polyethylene manufacturing, etc. A system that is not very sensitive to machining tolerance defects, easy to repair or maintain and highly energy efficient is achieved, since the known means for preventing rotation of the shaft with friction can be dispensed with.

DESCRIPTION OF THE FIGURES

The following figures are included as part of the explanation of at least one embodiment of the invention.

DETAILED DESCRIPTION OF THE INVENTION

Figure 1:
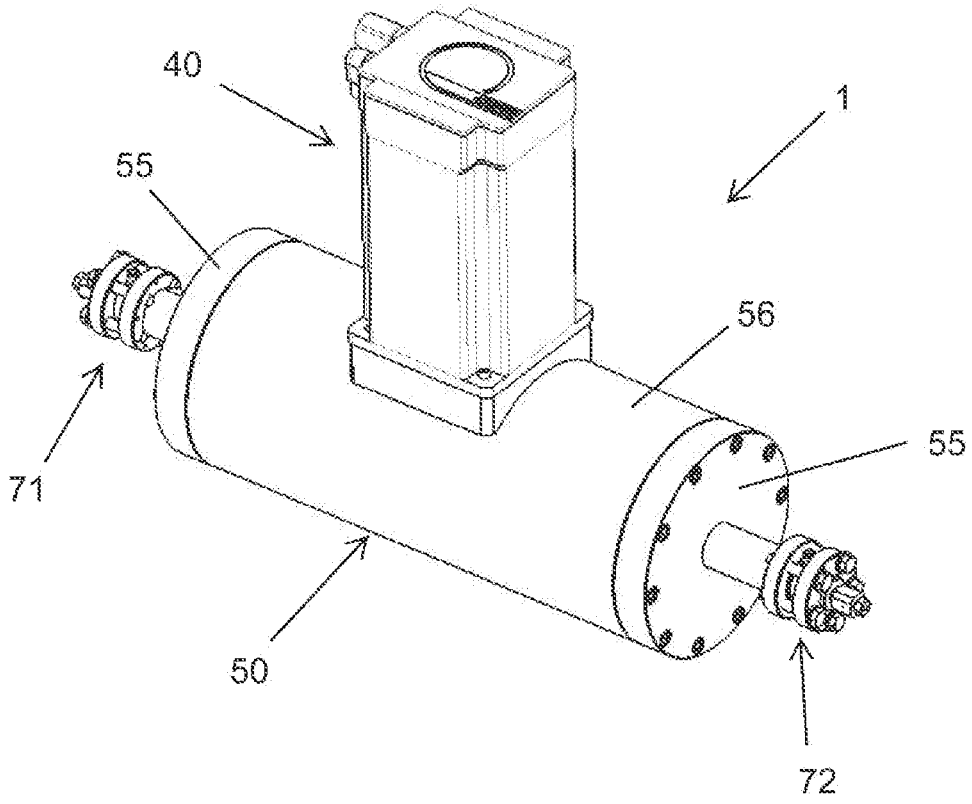
FIG. 1 shows a perspective view of an embodiment of a high-pressure pump according to the invention.
Figure 2:
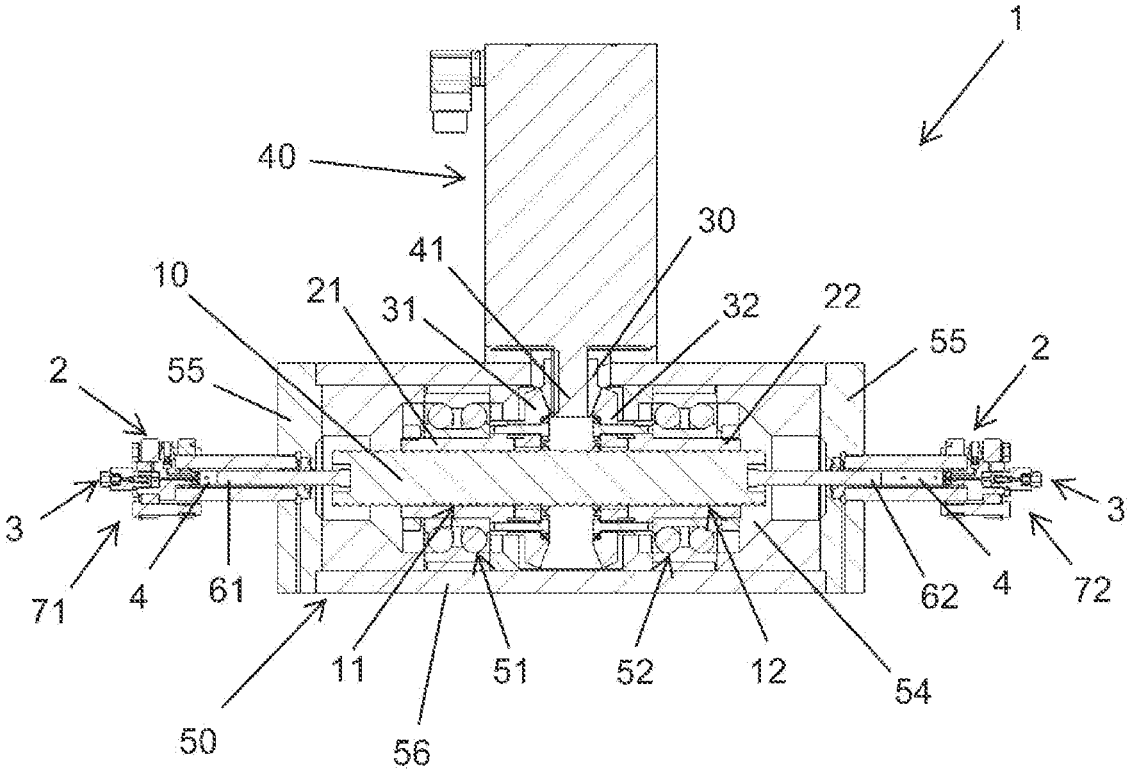
FIG. 2 shows a cross-section view of the high-pressure pump of the embodiment shown in FIG. 1 according to a plane containing the actuation shaft of the linear actuator and the drive shaft of the motor.
Figure 3:
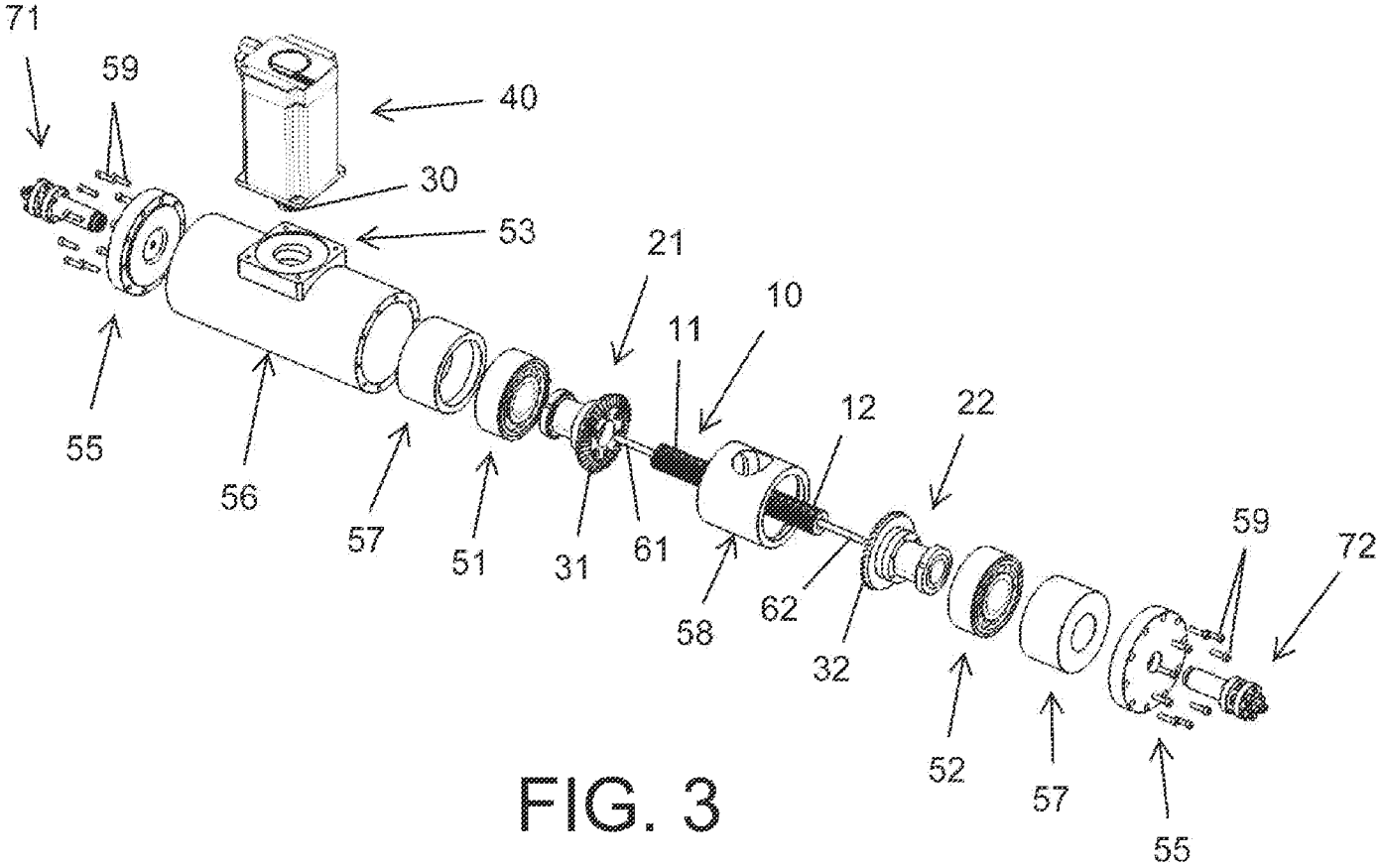
FIG. 3 shows an exploded perspective view of the high-pressure pump of the embodiment shown in FIG. 2.

According to an embodiment shown in the figures, the high-pressure pump (1) comprises a linear actuator with a rolling screw, comprising a shaft (10), a first nut (21) and a second nut (22). The nuts (21, 22) are operatively connected to a first threaded section (11) and a second threaded section (21) of the shaft (10), respectively, with said sections being configured with opposite threading directions. The nuts (21, 22) are fixed to the casing (50), where they can rotate about the shaft (10) by means of bearings (51, 52). The linear actuator further comprises a drive for driving the displacement of the shaft (10), simultaneously rotating the nuts (21, 22) in opposite directions. By rotating the nuts (21, 22) in opposite directions, the shaft (10) can be axially displaced with respect to the nuts (21, 22) in one and the same direction.

The shaft (10) has a threaded section or part (11) with its spiral to the right and another threaded section or part (12) of similar length, with its spiral to the left. There is located in each of these parts (11, 12) the respective nut (21, 22) with a thread or spiral direction in accordance with the area where it moves, that is, one nut (21) to the right and another nut (22) to the left. In this embodiment, both nuts (21, 22) have the same pitch and diameter. However, it is also contemplated that any combination of nut pitches, as well as, for example, independent motors (40) or transmission gears for the respective nuts (21, 22), can be used.

Means for preventing the unwanted rotation of the shaft (10) about same are thus provided. When the motor (40) rotates, the two nuts (21, 22) rotate simultaneously in opposite directions, providing the shaft with a torque of the same magnitude, but opposite direction, which is equal to half of the motor torque. A linear forward movement of the shaft (10) of the screw without rotation is thus achieved, where additional means for preventing rotation such as those known in the state of the art can be dispensed with, which increases the performance of the actuator and of the pump (1), reducing frictions and overheating.

By means of an alternative movement of the motor (40) in its two directions of rotation, a linear movement is achieved in the screw which can be utilized as drive for high-pressure pumping. The resulting movement of the shaft (10) in the screw is linear and rotation-free. The two nuts (21, 22) share the same torque of the motor (40), since each of the nuts works to counteract the torque of the other nut. Therefore, the system is mechanically symmetrical, acting in the same manner in the two directions. Therefore, in the symmetrical embodiment shown in the figures, the respective torques exerted by the nuts (21, 22) on the shaft (10) are identical, with identical angles of rotation, so the resulting movement of the shaft (10) is strictly linear.

The high-pressure pump (1) according to this embodiment comprises a first piston (61) and a second piston (62), the pistons (61, 62) being arranged on respective sides at the ends of the shaft (10), being able to be alternatively driven by the axial displacement of the shaft (10) to compress working fluid through the pump (1). The working fluid, for example, water, is supplied to and removed from the pump (1) through respective connections (71, 72) which incorporate a fluid inlet (2) and a fluid outlet (3), respectively. The fluid is compressed upon displacing the pistons (61, 62) in the respective compression cylinders or chambers (4).

The pump (1) can be driven by a single electric motor (40), fixed externally to the casing (50). The casing (50) has a cylindrical shape, with a side cover (56) and two end lids (55), which can be fixed to the side cover (56) by means of screws (59). In the side cover (56) the casing incorporates a side opening (53) for mechanically coupling the motor (40) to the linear actuator therethrough. The nuts (21, 22) and the respective bearings (51, 52) are fixed to the casing (50) by means of separator bushings (57, 58). Additionally, a housing (54) configured to contain an oil bath in which the shaft (10), the nuts (21, 22) and the transmission gear-pinion (30), as well as crown wheels (31, 32), are immersed for cooling and lubrication has been envisaged.

The separator bushings (57, 58) maintain the separation between bearings (51, 52). The lubrication and cooling oil is contained in said housing closed by the lids, where it can be recirculated and cooled. The lids (55) of the casing (50) are resistant to the thrush reaction transmitted by the shaft (10). Advantageously, this casing (50) allows simple machining.

The motor (40) is mechanically coupled to a transmission gear for rotating the nuts (21, 22). The transmission gear comprises a conical pinion (30) which meshes in a perpendicular manner with conical crown wheels (31, 32) integral with the first nut (21) and the second nut (22), respectively. Advantageously, the pinion-crown wheel system also enables providing a suitable torque increase with the available servomotors. The reduction necessary for torque and speed balancing can be adjusted by means of changing the size of the pinion (30) and the crown wheels (31, 32). A compact high-pressure pump (1) with low noise and low revolutions per minute of the motor (40) is thus provided.

The motor (40) can drive both nuts (21, 22) simultaneously by means of said gear arranged at 90 degrees with the shaft of the screw. This gear rotates a nut (21) in one direction and the other nut (22) in the opposite direction, with exactly the same number of rotation. The crown wheels (31, 32) of the nuts are arranged facing one another and have a diameter larger than the pinion (30) integral with the drive shaft (41) of the motor (40). As can be seen in the figures, the shaft (10), the nuts (21, 22), the pinion (30) and the crown wheels (31, 32), as well as the motor (40), are arranged symmetrically with respect to the plane of symmetry perpendicular to the shaft (10) of the linear actuator and containing the drive shaft (41) of the motor (40). Likewise, the threaded sections (11, 12) are arranged adjacent to the respective ends of the shaft (10).

LIST OF REFERENCE SIGNS

1 High-pressure pump
2 Pump water supply inlet
3 Pump ejection water outlet
4 Water compression chamber
10 Shaft of the rolling screw
11 First threaded segment of the shaft
12 Second threaded segment of the shaft
21 First nut of the rolling screw
22 Second nut of the rolling screw
30 Pinion of the transmission gear
31 First crown wheel of the transmission gear
32 Second crown wheel of the transmission gear
40 Drive motor
41 Motor shaft
50 Pump casing
51 First bearing for fixing the first nut to the casing
52 Second bearing for fixing the second nut to the casing
53 Side opening of the casing for coupling the motor
54 Housing of the casing for oil bath
55 End lid of the casing
56 Side cover of the casing
57 End separator bushing
58 Central separator bushing
59 Screw for fixing the end lid
61 First piston of the pump
62 Second piston of the pump
71 First pump water inlet and outlet connection
72 Second pump water inlet and outlet connection

The invention claimed is:

1. A linear actuator for a high-pressure pump (1), comprising a rolling screw with a shaft (10), a first nut (21) and a second nut (22), the nuts (21, 22) being operatively connected to a first threaded section (11) and a second threaded section (12) of the shaft (10), respectively, configured with opposite threading directions, such that when rotating the nuts (21, 22) in opposite directions, the shaft (10) can be axially displaced with respect to the nuts (21, 22) in one and the same direction, and a drive for driving the displacement of the shaft (10), simultaneously rotating the nuts (21, 22) in opposite directions.

2. The linear actuator according to claim 1, wherein the drive is configured to rotate the nuts (21, 22) simultaneously transmitting a substantially identical torque of opposite direction to the respective nuts (21, 22).

3. The linear actuator according to claim 1, wherein the drive comprises a transmission gear that can be coupled to a motor (40) for rotating the nuts (21, 22).

4. The linear actuator according to claim 1, wherein the transmission gear comprises a pinion (30) which meshes in a perpendicular manner with crown wheels (31, 32) integral with the first nut (21) and the second nut (22), respectively.

5. The linear actuator according to claim 1, wherein the number of teeth on the pinion (30) is an even number.

6. The linear actuator according to claim 1, wherein the shaft (10), the nuts (21, 22) and/or the drive are configured symmetrically with respect to a plane of symmetry perpendicular to the shaft (10).

7. The linear actuator according to claim 1, wherein the threaded sections (11, 12) are arranged adjacent to the respective ends of the shaft (10).

8. The linear actuator according to claim 1, wherein the drive comprises at least one motor (40), each motor (40) configured to rotate at least one of the nuts (21, 22).

9. A high-pressure pump (1), comprising a linear actuator according to claim 1, a (61) and a second piston (62), the pistons (61, 62) being arranged on respective sides at the ends of the shaft (10), being able to be alternatively driven by the axial displacement of the shaft (10) to compress fluid through the pump (1).

10. The high-pressure pump (1) according to claim 1, comprising a casing (50) enclosing the shaft (10), the nuts (21, 22) and/or a transmission gear, the nuts (21, 22) being arranged fixed to the casing (50) where they can rotate about the shaft (10) by means of bearings (51, 52).

11. The high-pressure pump (1) according to claim 10, wherein the casing (50) comprises a housing (54) configured to contain an oil bath in which the shaft (10), the nuts (21, 22) and/or the transmission gear are immersed.

12. The high-pressure pump (1) according to claim 1, wherein the casing (50) comprises a side opening (53) for mechanically coupling the motor (40) to the linear actuator, the motor (40) being arranged externally to the casing (50).

* * * * *